US008571395B2

(12) United States Patent
Porterfield et al.

(10) Patent No.: US 8,571,395 B2
(45) Date of Patent: Oct. 29, 2013

(54) TRACK SYSTEM FOR HEATER ASSEMBLY

(75) Inventors: Donald E. Porterfield, Lascassas, TN (US); Jerry L. Hensley, Lebanon, TN (US); Charles T. Whitfield, Murfreesboro, TN (US)

(73) Assignee: Backer EHP Inc., Murfreesboro, TN (US)

( * ) Notice: Subject to any disclaimer, the term of this patent is extended or adjusted under 35 U.S.C. 154(b) by 275 days.

(21) Appl. No.: 12/891,182

(22) Filed: Sep. 27, 2010

(65) Prior Publication Data

US 2012/0074129 A1 Mar. 29, 2012

(51) Int. Cl.
*F24H 3/02* (2006.01)
*A61H 33/08* (2006.01)
*H05B 3/06* (2006.01)

(52) U.S. Cl.
USPC ..... 392/360; 392/363; 392/379; 219/520; 219/523; 219/536

(58) Field of Classification Search
USPC ..... 219/54, 385, 386, 200, 540, 536–539, 219/520–525; 312/334.1, 334.4, 334.7, 312/334.8, 334.16, 350; 392/354, 355, 356, 392/357, 358, 359, 360, 361, 362, 363, 364, 392/365, 366, 367, 368, 369, 379
See application file for complete search history.

(56) References Cited

U.S. PATENT DOCUMENTS

| | | | | | |
|---|---|---|---|---|---|
| 4,252,382 | A * | 2/1981 | Thomas | 384/18 |
| 5,124,534 | A * | 6/1992 | Williams et al. | 219/532 |
| 5,276,310 | A * | 1/1994 | Schmidt et al. | 219/521 |
| 6,072,159 | A * | 6/2000 | Wilkie et al. | 219/403 |
| 6,166,353 | A * | 12/2000 | Senneville et al. | 219/385 |
| 6,215,108 | B1 * | 4/2001 | Butcher et al. | 219/537 |
| 6,238,031 | B1 * | 5/2001 | Weng | 312/333 |
| 6,547,081 | B1 * | 4/2003 | Kaminski | 211/26 |
| 2004/0169030 | A1 * | 9/2004 | Seibert et al. | 219/386 |
| 2010/0007255 | A1 * | 1/2010 | Cheng | 312/334.44 |

* cited by examiner

*Primary Examiner* — Tu B Hoang
*Assistant Examiner* — Michael LaFlame, Jr.
(74) *Attorney, Agent, or Firm* — Neal, Gerber & Eisenberg LLP

(57) ABSTRACT

A heater assembly includes a heating element assembly having a resistive heating element connected to a housing member. First and second guide members are oppositely and outwardly positioned with respect to the heating element assembly and extend away from the housing member. A patch plate includes an installation aperture and first and second wings extending away from the patch plate. The first and second guide members are positioned to individually slidingly engage with one of the first and second wings thereby defining a track system to permit the heating element assembly to be slidingly received through the installation aperture without contact between the resistive heating element and the patch plate.

21 Claims, 11 Drawing Sheets

TRACK SYSTEM FOR HEATER ASSEMBLY

FIELD

The present disclosure relates to electrical heaters and appliances including resistive heating element open coil heaters that include features to mitigate against heating element damage during installation.

BACKGROUND

This section provides background information related to the present disclosure which is not necessarily prior art.

An open coil heater generally includes a resistive heating element to generate heat. The resistive heating element is generally in the form of a coiled wire and generates heat as electrical current passes therethrough. The resistive heating element is in direct contact with a surrounding fluid, such as air or water, for example. Heat exchange between the resistive heating element and the surrounding fluid is efficient, therefore providing a quick response time.

Commonly known open coil elements used as the resistive heating element are exposed to the surrounding fluid on multiple sides to enhance heat transfer. This open design, however, can permit contact between a coiled wire of the open coil element and the cabinet or plenum into which the open coil element is being installed. This contact can result in damage which may not be immediately visible or apparent to the installer, therefore significant time may be required to identify a damaged open coil element or to replace the damaged open coil element after initial installation.

SUMMARY

This section provides a general summary of the disclosure, and is not a comprehensive disclosure of its full scope or all of its features.

According to several embodiments, a heater assembly includes a heating element assembly having a resistive heating element connected to a housing member. At least one guide member is connected to the housing member and extends away from the housing member. A patch plate has an installation aperture and at least one wing extending perpendicular to the patch plate and parallel to the at least one guide member. The at least one guide member is positioned to slidingly engage with the at least one wing to permit the heating element assembly to be slidably received through the installation aperture without contact between the resistive heating element and the patch plate.

According to other embodiments, a heater assembly includes a heating element assembly having a resistive heating element connected to a housing member. First and second guide members are oppositely and outwardly positioned with respect to the heating element assembly and extend angularly away from the housing member. A patch plate includes an installation aperture and first and second wings extending angularly away from the patch plate. The first and second guide members are positioned to individually slidingly engage with one of the first and second wings thereby defining a track system to permit the heating element assembly to be slidably received through the installation aperture without contact between the resistive heating element and the patch plate.

According to still other embodiments, a heating system includes a first heating element assembly having a resistive heating element connected to a housing member. The heating element assembly is movable to insert the resistive heating element into a heating unit. A track system includes first and second guide members oppositely and outwardly positioned with respect to the heating element assembly and extending away from the housing member. The first and second guide members each include a longitudinal wall connected to the housing member and an end wall angularly oriented with respect to the longitudinal wall, the end wall positioned proximate to a free end of the heating element assembly. A patch plate has an installation aperture and first and second wings extending away from the patch plate. The first and second guide members are positioned to individually slidingly engage with one of the first and second guide members to permit the heating element assembly to be slidingly received through the installation aperture without contact between the resistive heating element and the patch plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
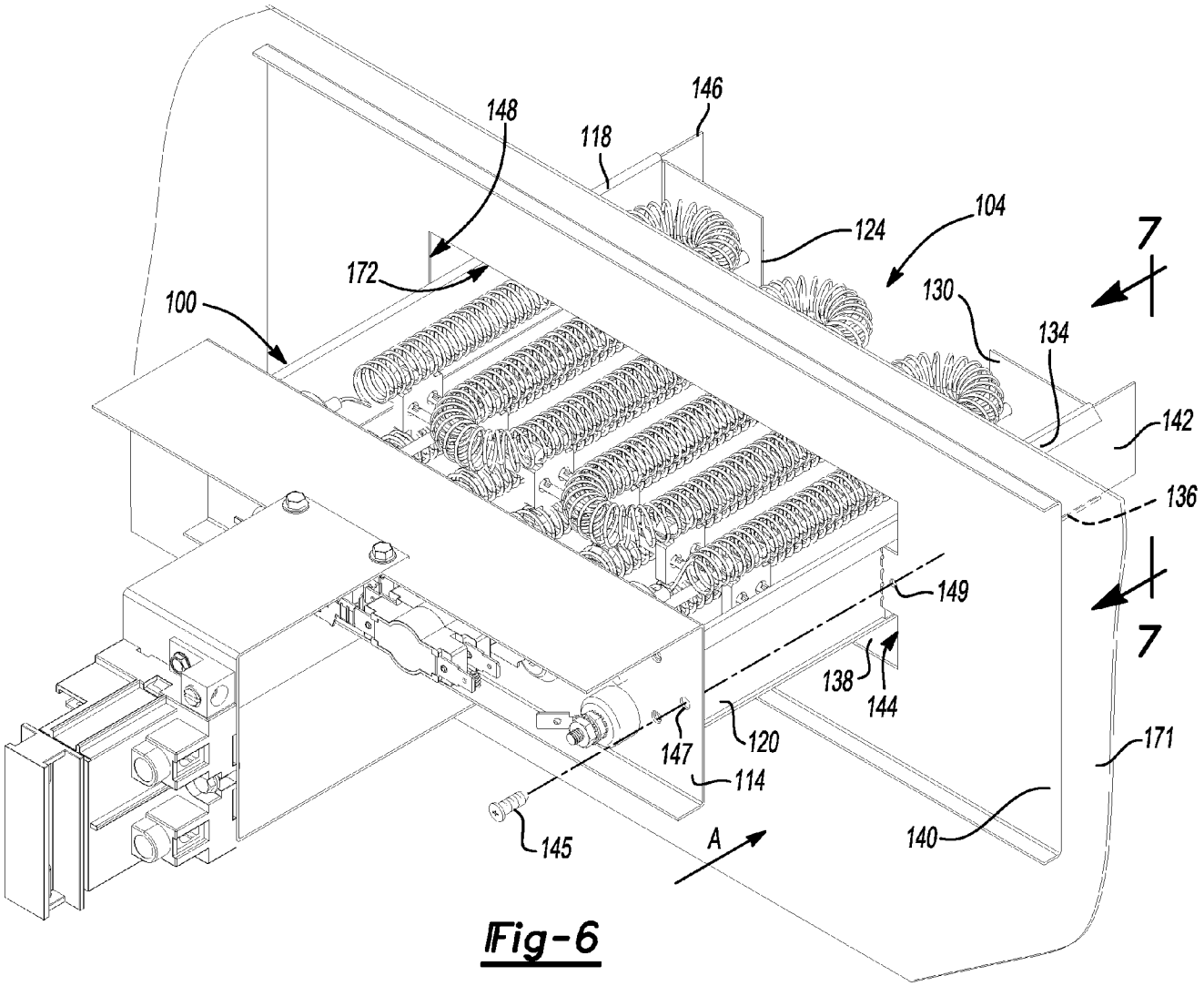
FIG. 6 is a left rear perspective view of the electric heater of FIG. 4 in a partially installed position.
Figure 10:
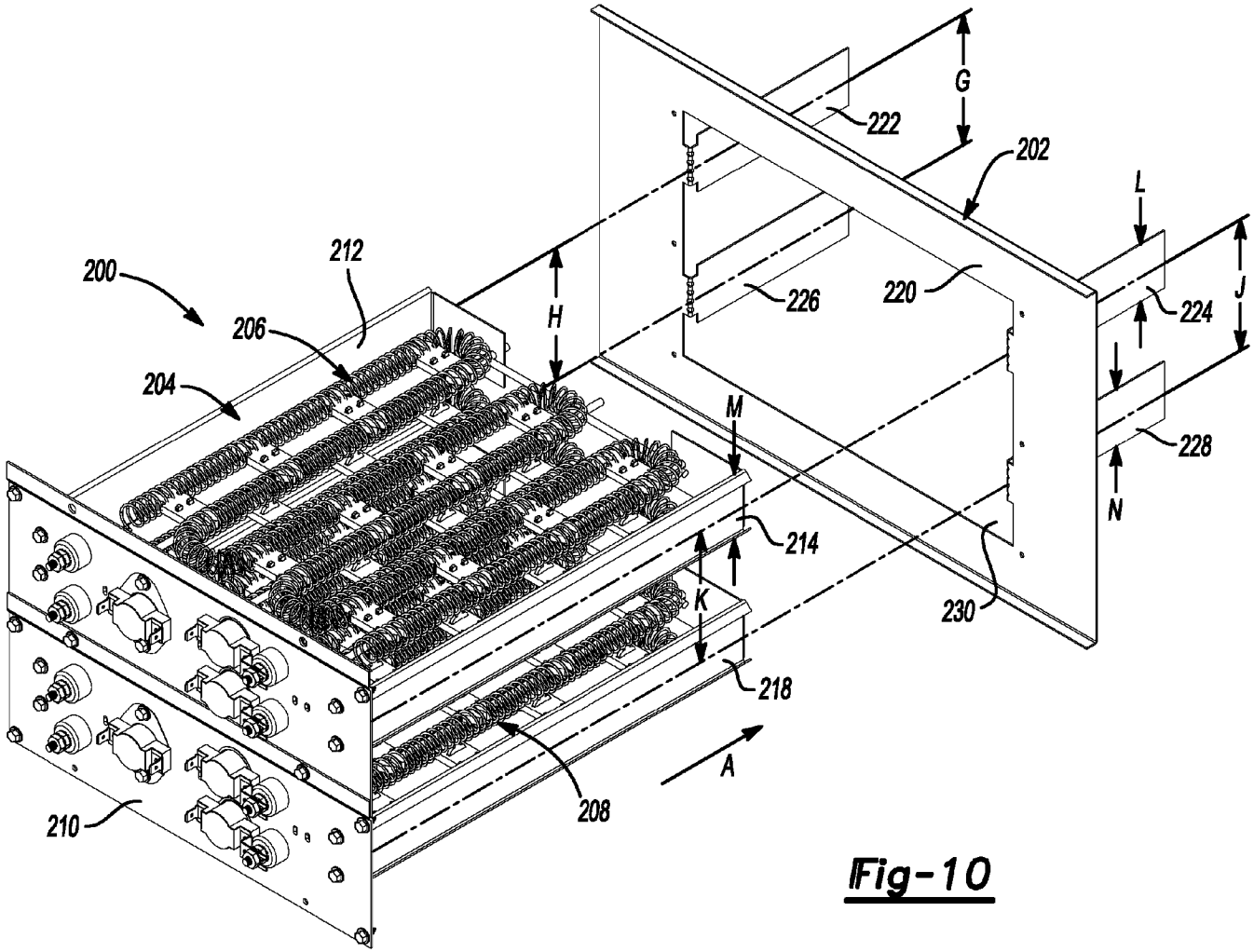
FIG. 10 is a front right perspective view of another embodiment of an electric heater of the present disclosure.
Figure 11:
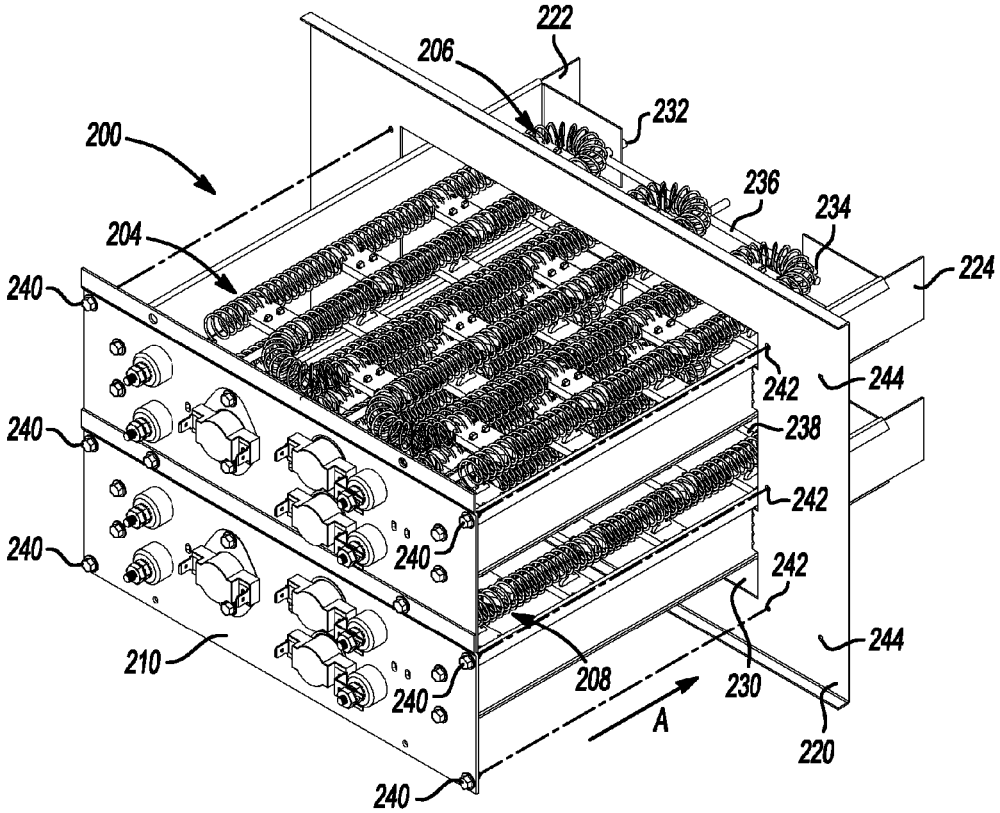
Figure 12:
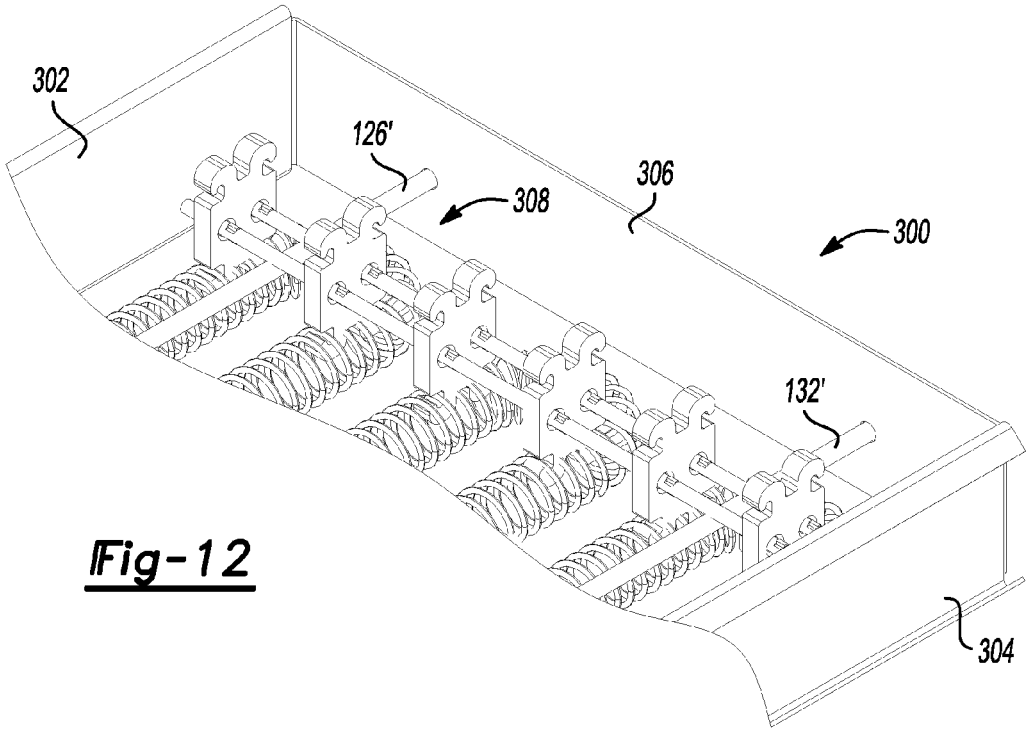
Figure 13:
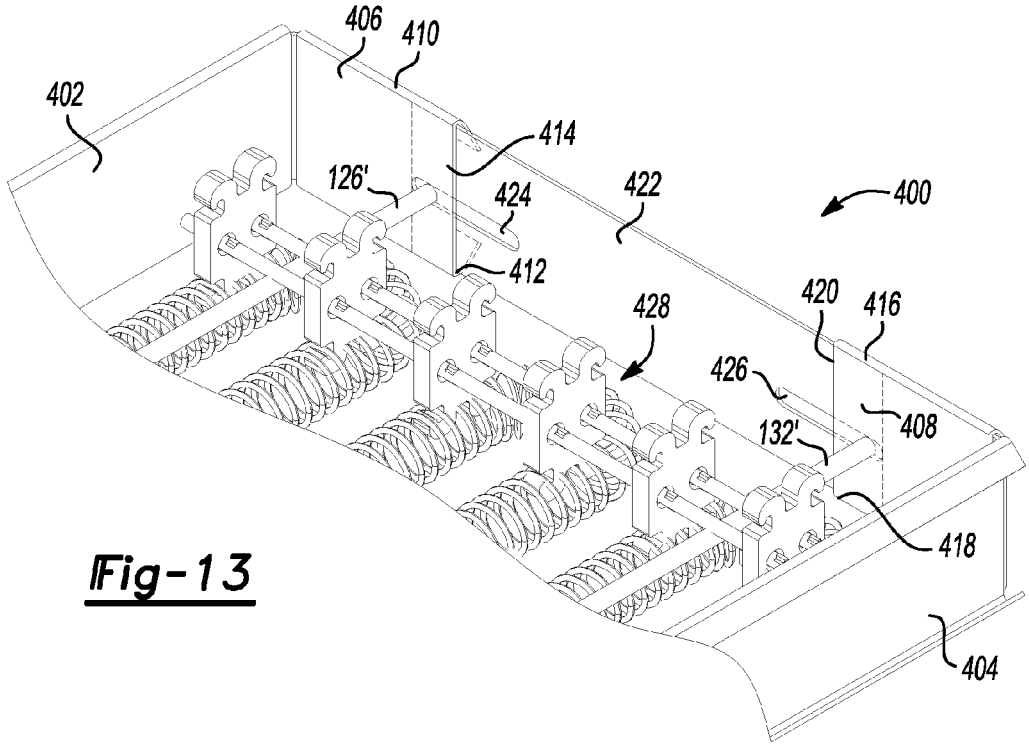

FIG. 11 is top right perspective view of the electric heater of FIG. 10 in a partially installed position; and FIG. 12 is a left rear perspective view similar to FIG. 6 showing a portion of another embodiment of an electric heater having an integral end wall; and FIG. 13 is a left rear perspective view showing a portion of another embodiment of an electric heater modified from FIG. 12 to include a sliding end wall.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
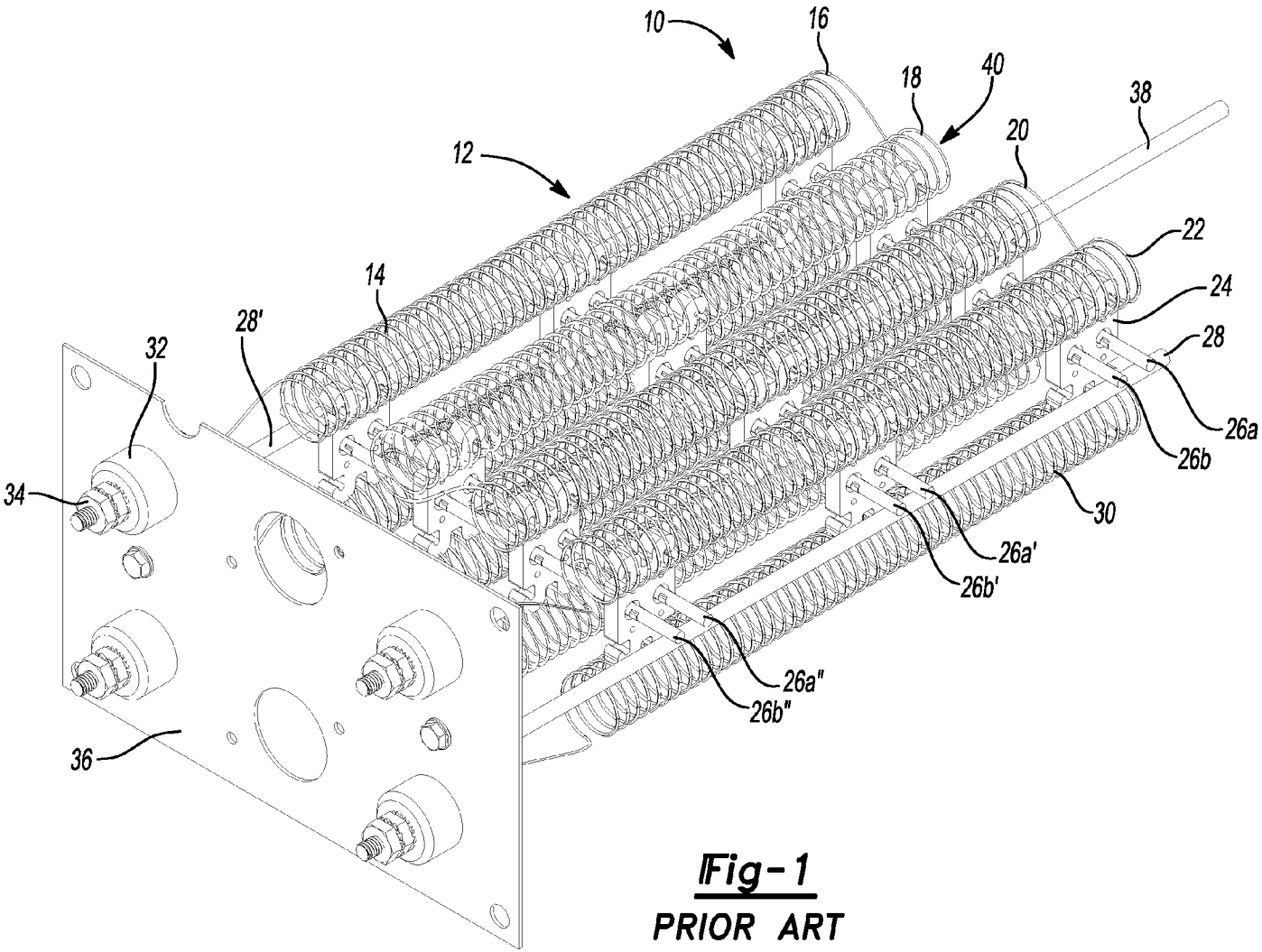
Fig-1 PRIOR ART
FIG. 1 is a front right perspective view of a prior art electric heater.

Referring to FIG. 1, an electrical heater 10 includes a heating element assembly 12 having a first heating element configuration 14. First heating element configuration 14 provides one or more coil members which include a first coil member 16, a second coil member 18, a third coil member 20, and a fourth coil member 22. Each of the first, second, third, and fourth coil members 16, 18, 20, 22 are sequentially arranged in series with each other. Other types of resistive heating elements such as coated induction heating members can also be used. A plurality of non-conductive material spacer members 24 are used to support individual portions of the first, second, third, and fourth coil members 16, 18, 20, 22 of the first coil configuration 14.

A plurality of transverse support rods 26 oriented perpendicular to the longitudinal orientation of the coil members of first coil configuration 14 are identified as transverse support rods 26*a*, 26*b*, 26*a*', 26*b*', 26*a*", 26*b*". The transverse support rods 26 extend through and therefore support each of the plurality of spacer members 24. Each of the transverse support rods 26 are in turn supported by longitudinal coil support rods 28, 28' fixed to, positioned directly below, or releasably connected to the transverse support rods 26. A second coil configuration 30 which according to several embodiments is positioned below first coil configuration 14 is substantially identical to first coil configuration 14, and is therefore not further described herein. Individual coils of second coil configuration 30 are supported by opposite ends of the plurality of spacer members 24, which as noted above are individually supported by the plurality of transverse support rods 26 and longitudinal coil support rods 28, 28'.

A plurality of connectors 32 are coupled to opposite ends of each of the first and second coil configurations 14, 30. Connectors 32 are fastenably connected using fasteners 34 to a housing member 36. Each of the longitudinal coil support rods 28, 28' are also fastenably connected at one end to housing member 36. A longitudinal element assembly support rod 38 is connected at one end to housing member 36 and extends beyond an assembly free end 40 of heating element assembly 12. The purpose for assembly support rod 38 will be further described in reference to FIG. 2. As is evident from the configuration shown in FIG. 1, the individual coils of the first and second coil configurations 14, 30 are not provided with external protection such as housings in order to maximize the potential for airflow past the coils. The configuration shown, however, can be susceptible to damage to the coils during installation as discussed below in reference to FIG. 2.

Figure 2:
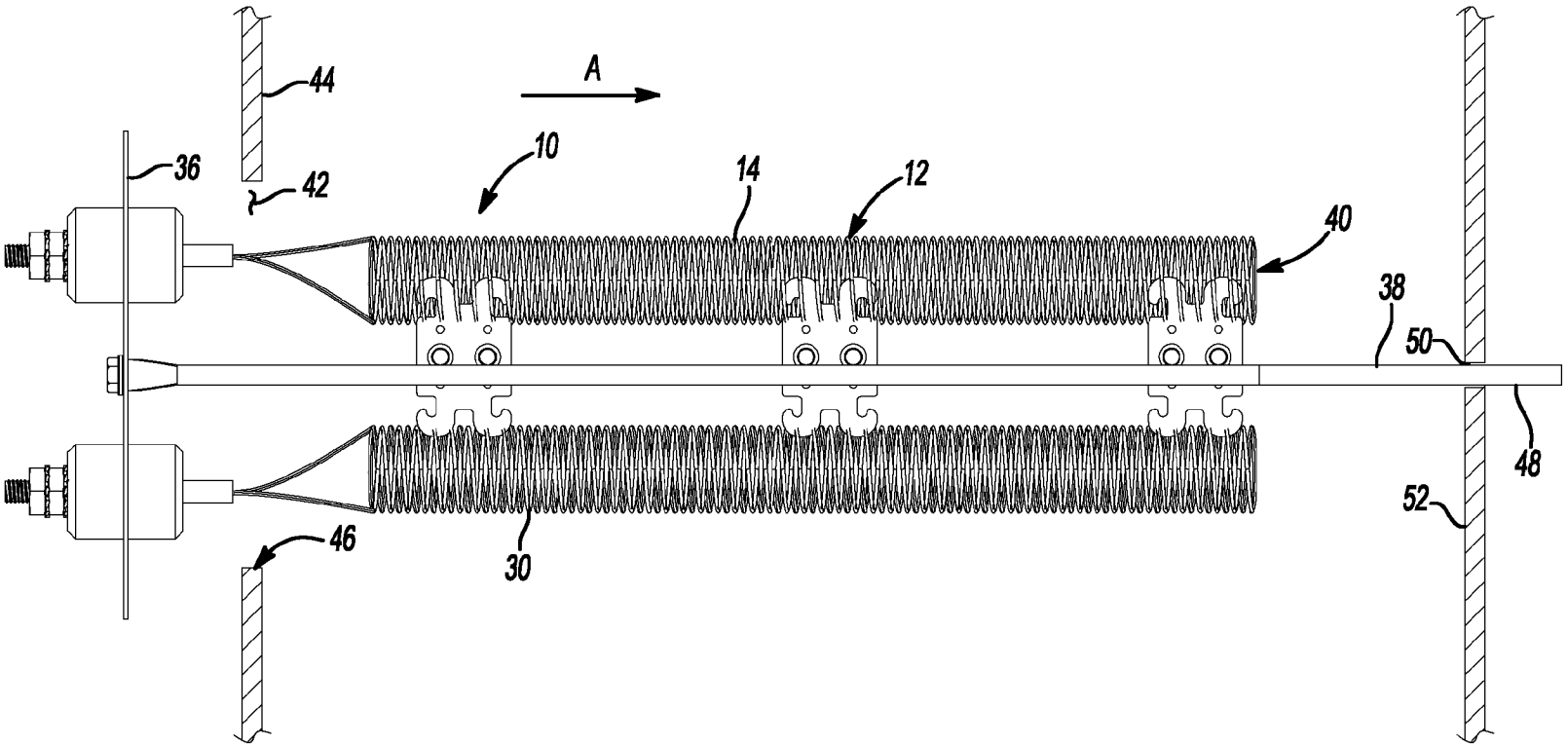
Fig-2 PRIOR ART
FIG. 2 is a side elevational view of the electric heater of FIG. 1.

Referring to FIG. 2, prior art heating element assembly 12 is installed by insertion in an installation direction "A" by inserting the heating element assembly 12 through an installation aperture 42 created in a first plenum wall 44 of a heating unit 45, such as a furnace or air handler. The size of installation aperture 42 must be large enough to permit the installer to reach around heating element assembly 12 and through installation aperture 42 during installation, while at the same time preventing contact between any of the first or second coil configurations 14, 30 with a perimeter edge 46 defined by installation aperture 42 or any other feature of the heating unit 45.

The installer requires access through installation aperture 42 in order to hold and guide a rod free end 48 of assembly support rod 38 to manually align rod free end 48 with a rod alignment aperture 50 created in a second plenum wall 52. Once the rod free end 48 is inserted through rod alignment aperture 50, the installer continues to move electrical heater 10 in the installation direction "A" until housing member 36 abuts against first plenum wall 44. Housing member 36 is then connected such as by fastening to first plenum wall 44 to complete the installation of electrical heater 10. Rod alignment aperture 50, having rod free end 48 extending therethrough, provides support at the assembly free end 40 of heating element assembly 12 to prevent contact between any of the coil members of first or second coil configurations 14, 30 or to structure of the plenum or furnace, which could damage the coil members. The installation of rod free end 48 into rod alignment aperture 50 is commonly done "blind" by the installer who is positioned facing first plenum wall 44 and therefore may not see rod alignment aperture 50 during installation. This can also result in further damage to one or more of the coil members.

Figure 3:
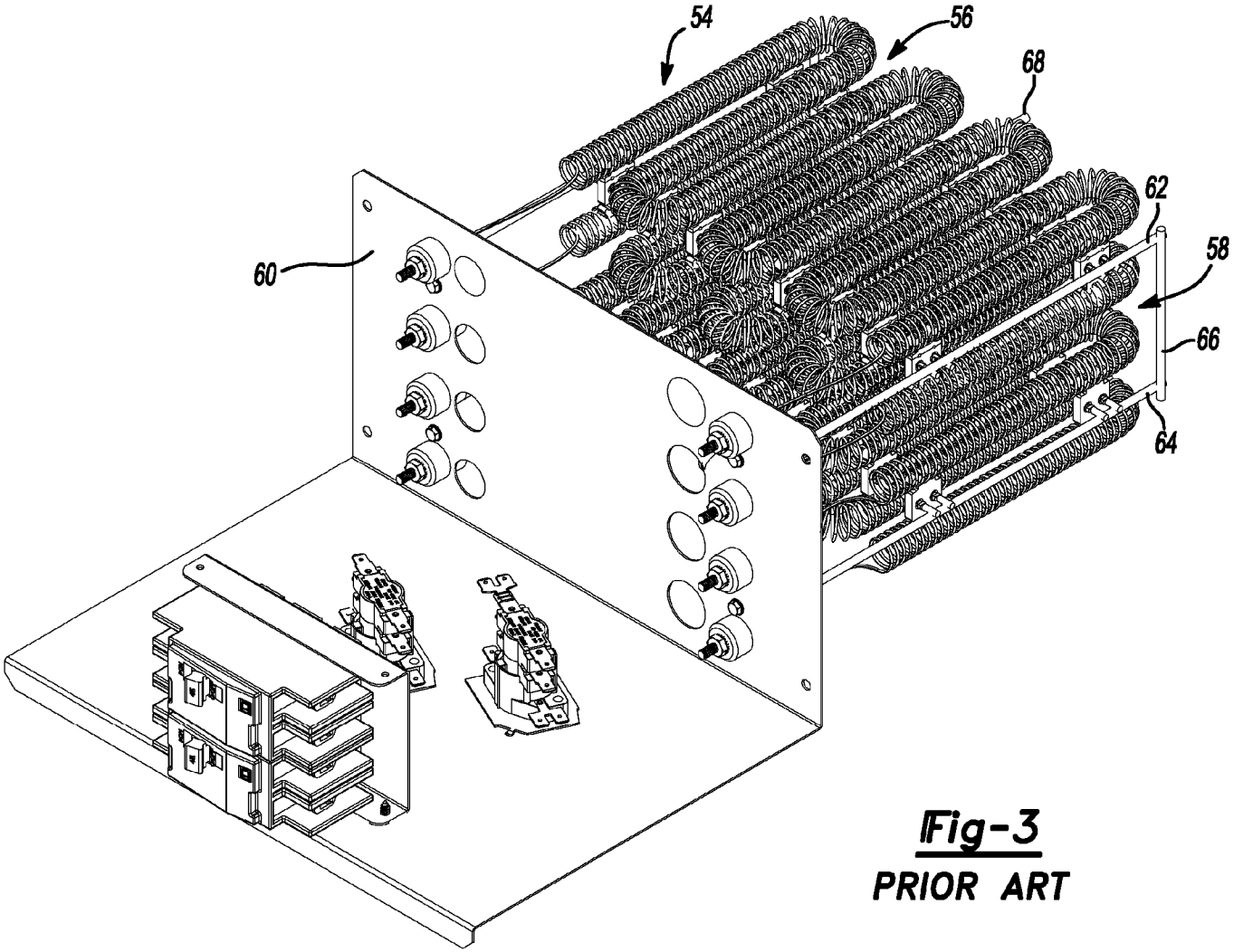
Fig-3 PRIOR ART
FIG. 3 is a front right perspective view of another embodiment of a prior art electric heater.

Referring to FIG. 3, alternate embodiments for known electrical heaters include an electrical heater 54 having a quad coil heating element assembly 56. An assembly free end 58 of heating element assembly 56 faces away from a housing member 60. Housing member 60 can fastenably or in a similar manner mechanically connect to heating element assembly 56.

Electrical heater 54 can further include first and second longitudinal coil support rods 62, 64 duplicated on opposite sides of heating element assembly 56. First and second longitudinal coil support rods 62, 64 are individually fastenably connected to housing member 60 at one end and include a connecting rod 66 fastenably connected to both first and second longitudinal coil support rods 62, 64 proximate to the assembly free end 58 of heating element assembly 56. The first and second longitudinal coil support rods 62, 64 provide for support of transverse support rods similar to the embodiment shown in FIG. 1. The configuration of electrical heater 54 is susceptible to the same types of coil damage during installation as the embodiment shown and described with reference to FIG. 1 because heating element assembly 56 also includes an assembly support rod 68 which must be similarly inserted through an aperture (not shown) of a rear or back plenum wall (not shown).

Figure 4:
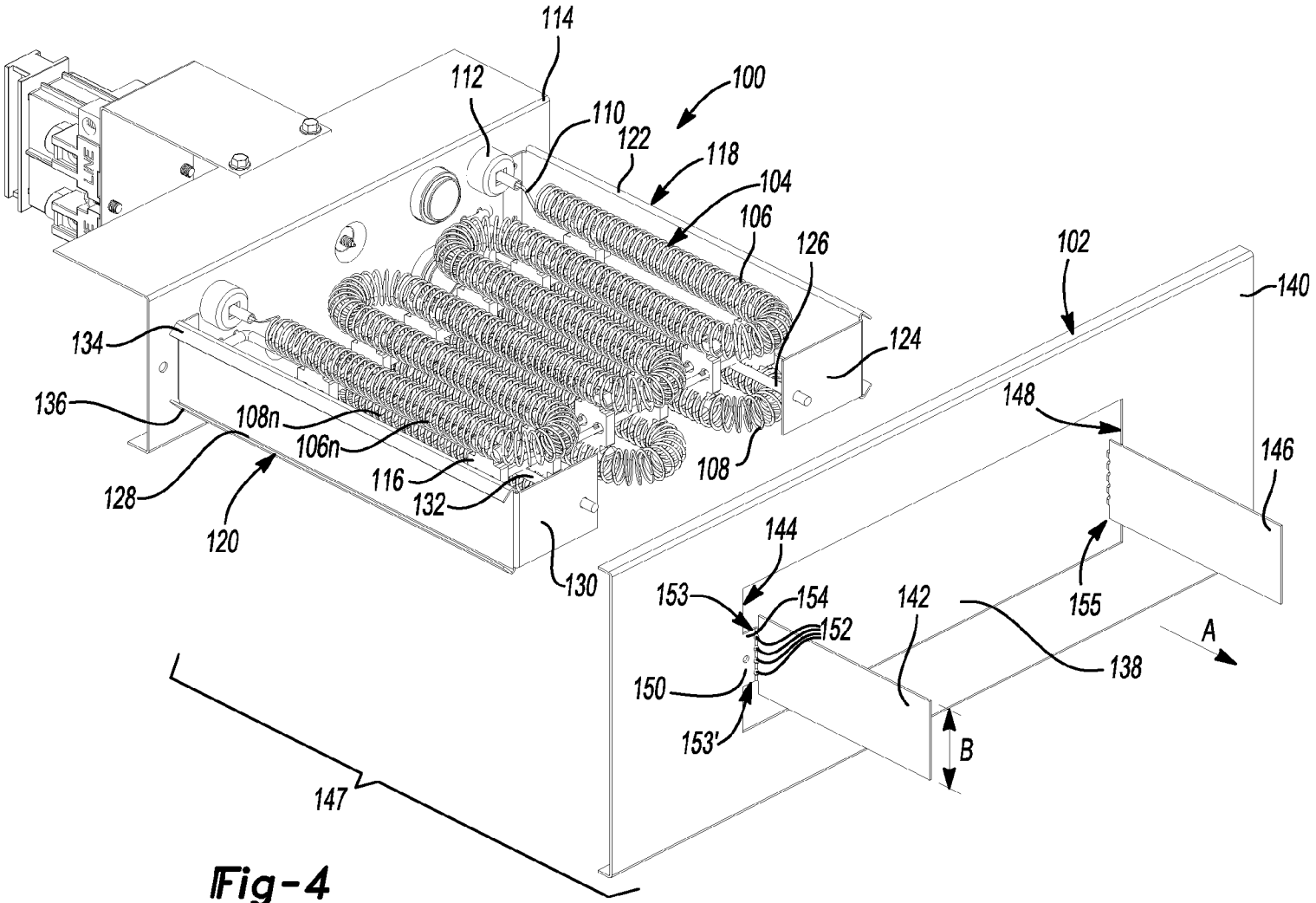
FIG. 4 is a left front perspective view of an electric heater with a track slide of the present disclosure.

Referring to FIG. 4, an electrical heater 100 according to the principles of the present disclosure is mounted using a patch plate 102 in the installation direction "A". Electrical heater 100 includes a heating element assembly 104 having at least one and according to several embodiments multiple resistive heating elements depicted for example as an open coil configuration of first and second coil members 106, 108 which individually include coil members 106 through **106*n* and second coil members 108 through 108*n*. The quantity of coil members "n" used in heating element assembly 104 is not limiting. Each of the first and second coil members 106, 108 is electrically connected using an element connecting end 110 at opposite ends of the coil members to individual ones of a plurality of connectors 112, each fastenably connected to a housing member 114**.

A plurality of spacer members 116 are connected to and support the first and second coil members 106, 108. Each of the first and second coil members 106, 108 is positioned between a first guide member 118 and a second guide member 120. First guide member 118 includes a first longitudinal wall 122, extending angularly away from and according to several embodiments perpendicular with respect to housing member 114, and a first end wall 124, which extends angularly away from first longitudinal wall 122. According to several embodiments first end wall 124 is oriented substantially parallel with respect to housing member 114 and therefore perpendicular with respect to first longitudinal wall 122. First end wall 124 can be formed, for example, by bending a free end of first longitudinal wall 122. A first support rod 126 is connected at a first end to housing member 114 and extends through and is supported by first end wall 124 at a second end.

Figure 8:
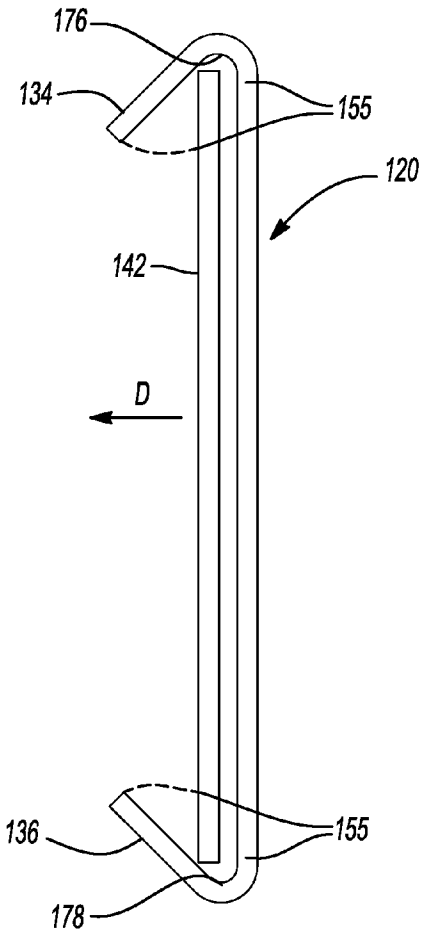
FIG. 8 is the end elevational view of the guide member of FIG. 7 further showing a first wing in sliding contact.
Figure 7:
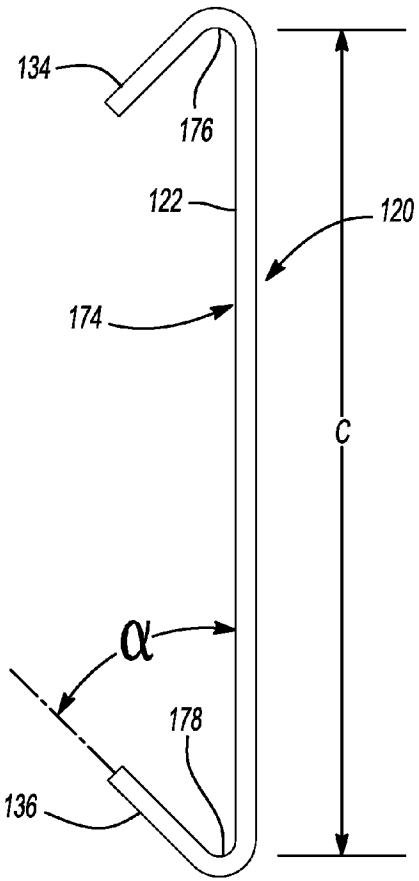
FIG. 7 is an end elevational view of a guide member of the present disclosure.

Second guide member 120 is substantially a mirror image of first guide member 118 and includes a second longitudinal wall 128 and a second end wall 130. A second support rod 132 is similarly connected at a first end to housing member 114 and extends through and is supported by second end wall 130 at a second end. Each of the first and second guide members 118, 120 includes first and second guide flanges 134, 136 which face outwardly and away from heating element assembly 104. First and second guide flanges 134, 136 will be described in greater detail in reference to FIGS. 7 and 8.

Patch plate 102 includes an installation aperture 138 sized to allow free insertion of the heating element assembly 104 in the installation direction "A" until housing member 114 contacts a patch plate body 140. Patch plate 102 further includes a first wing 142 created of the same material as patch plate body 140 and positioned proximate to a first edge wall 144 of installation aperture 138. First wing 142 is oriented angularly away from patch plate body 140 and according to several embodiments is oriented perpendicular to patch plate body 140 and is therefore oriented parallel to second guide member 120. A second wing 146 is created similar to first wing 142 from a connection proximate to a second edge wall 148 of installation aperture 138. Each of the first and second wings 142, 146 has a wing height "B". The first and second guide members 118, 120 and the patch plate 102 having installation aperture 138 and first and second wings 142, 146, together define a track system 147 which permits the heating element assembly 104 to be slidably received through the installation aperture 138 without contact between the resistive heating elements such as coil members 106, 108 with the patch plate 102.

As previously noted, each of the first and second wings 142, 146 is similarly created therefore the following discussion of first wing 142 applies equally to second wing 146. An extending portion 150 extends inwardly (i.e., into installation aperture 138) with respect to first edge wall 144. A plurality of axially aligned apertures 152 can be created in extending portion 150 to define a bend location at which first wing 142 is bent or formed to extend away from patch plate body 140, and according to several embodiments first wing 142 extends perpendicular with respect to patch plate body 140. First wing 142 is integrally attached to extending portion 150 by a plurality of lands 154 that remain after creation of the plurality of axially aligned apertures 152. Each of the first and second wings 142, 146 also includes upper and lower wing extension portions 155, which extend both above and below the upper and lower boundaries or edges 153, 153' of the extending portions 150. The wing extension portions 155 provide sliding clearance between the wing and the edge wall for first and second guide flanges 134, 136, shown and described in better detail in reference to FIGS. 7 and 8.

Figure 5:
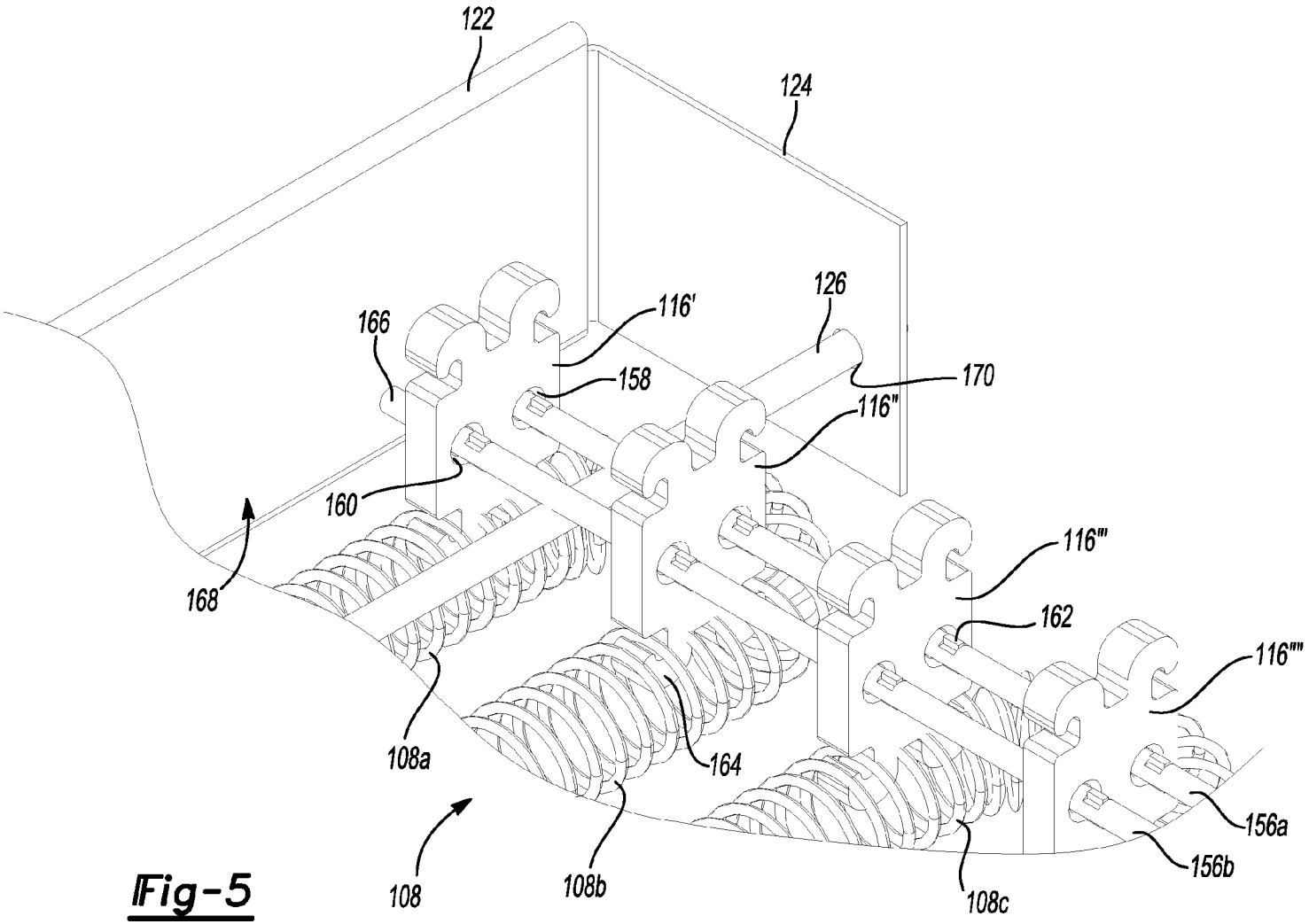
FIG. 5 is a top perspective view of a portion of an electric heater assembly of the electric heater of FIG. 4.

Referring to FIG. 5, portions of second coil members **108*a*, 108*b*, 108*c* are shown in greater detail and with respect to a plurality of transverse support rods 156*a*, 156*b* (only two of which are shown in this view). Transverse support rods 156*a*, 156*b* are each oriented substantially perpendicular with respect to second coil members 108. Each of the transverse support rods 156*a*, 156*b* extends through either first or second through apertures 158, 160 individually created in the plurality of spacer members 116 shown for example as spacer members 116', 116'', 116''', 116''''. Each of the transverse support rods 156*a*, 156*b* can also include a plurality of extending members 162 located proximate to individual ones of the spacer members 116 used to retain a relative position of the individual spacer members 116 with respect to the position of the second coil members 108. Extending members 162** can be formed such as by a coining operation of the material of the transverse support rods.

Each of the plurality of spacer members 116 also includes a plurality of hook members 164, which can be interspaced to support the individual coils of second coil members 108 (as well as first coil members 106 (not shown)). A rod free end 166 of each of the transverse support rods 156 extends beyond the outermost one of the spacer members 116 and can contact an inner facing surface 168 of first longitudinal wall 122, or similarly of an inner facing surface (not shown in this view) of second longitudinal wall 128. Rod free ends 166 can therefore be used to retain a relative position of the coil members between the first and second guide members 118, 120.

First support rod 126 is slidably disposed through a first rod alignment aperture 170 created in first end wall 124. The second support rod 132, shown and described in reference to FIG. 4, is similarly connected through second end wall 130. A stiffness of first longitudinal wall 122 and first end wall 124 therefore provides support via first support rod 126 for the coil members, such as coil members 108. First support rod 126 is positioned below each of the transverse support rods 156*a*, 156*b* such that the weight of the coil members, the spacer members 116, and the transverse support rods 156 is supported by first support rod 126.

Referring to FIG. 6, electrical heater 100 is shown during installation in the installation direction "A" and partially extending through installation aperture 138 of patch plate body 140. Prior to this step, an existing patch plate body (not shown) that is connected to a heating unit such as an air handler having an enclosure wall 171 is removed. Patch plate body 140 of the present disclosure is then connected such as by fastening to enclosure wall 171 with installation aperture 138 of patch plate body 140 aligned with a clearance aperture (shown and described in reference to FIG. 9) of enclosure wall 171. A sliding installation is provided for electrical heater 100 by initially aligning the first and second wings 142, 146 between the first and second guide flanges 134, 136 of both first and second guide members 118, 120. First and second guide flanges 134, 136 thereafter provide for sliding support of electrical heater 100 with respect to first and second wings 142, 146. The spacing provided by first and second wings 142, 146 prevents the resistive heating elements such as the various coil members of heating element assembly 104 from contacting first or second edge walls 144, 148 and also prevent contact with a perimeter surface 172 defined by installation aperture 138 and further with respect to enclosure wall 171. Installation clearance is available because the individual coil members of heating element assembly 104 are all contained between first and second guide members 118, 120. First and second guide members 118, 120 when in sliding engagement with first and second wings 142, 146 prevent side-to-side and up-and-down displacement of heating element assembly 104 during installation.

Installation of electrical heater 100 is completed after sliding into installation aperture 138 by engagement of fasteners 145 to releasably fix housing member 114 to patch plate body 140. Fasteners 145 are inserted through apertures 147 sized for sliding clearance of fasteners 145 and threaded into engagement with apertures 149 created in patch plate body 140. Although additional support of housing member 114 is provided by first and second wings 142, 146, fasteners 145 provide a predominant percentage of the holding force to retain housing member 114 in the installed condition with respect to patch plate body 140.

Referring to FIG. 7 and again to FIG. 4, the geometry of second guide member 120 is similar to the geometry of first guide member 118; therefore, the following discussion of second guide member 120 applies equally to first guide member 118. First longitudinal wall 122 includes an outward facing surface 174 having both first and second guide flanges 134, 136 facing toward each other and together extending outwardly away from outward facing surface 174. Both first and second guide flanges 134, 136 are oriented at an acute angle $\alpha$ with respect to outward facing surface 174 such that first guide flange 134 defines a first capture zone 176 and second guide flange 136 defines a second capture zone 178. A capture zone height "C", defined between first and second capture zones 176, 178, is greater than the wing height "B" of first and second wings 142, 146 to allow guide flange sliding clearance with respect to the wing.

Referring to FIG. 8 and again to FIG. 4, as first wing 142 is aligned with and is slidably received within first and second capture zones 176, 178, the wing extension portion 155 at opposite ends of first wing 142 can slide with respect to first and second capture zones 176, 178 in a direction toward or away from the viewer as viewed in FIG. 8. The wing extension portions 155 are prevented from displacement in an outward displacement direction "D" (away from first and second coil members 106, 108) which is oriented perpendicular to the installation direction "A" by first and second guide flanges 134, 136. Therefore first and second guide flanges 134, 136 and second guide member 120 can only move in a sliding motion in the installation direction "A" with respect to first wing 142. Removal of heating element assembly 104 would therefore require an opposite sliding motion.

Referring to FIG. 9 and again to FIG. 6, for clarity a partially assembled condition of electrical heater 100 is shown to identify the pre-insertion positioning of an assembly free end 180 of heating element assembly 104 prior to insertion through a clearance aperture 182 created in enclosure wall 171. Clearance aperture 182 is larger than installation aperture 138 to provide clearance for electrical heater 104 and for installation fasteners. As previously noted, in a preferred installation sequence the patch plate body 140 is first fastened to the enclosure wall 171. To mount patch plate body 140, fasteners 188 are inserted through clearance apertures 190 created in patch plate body 140 to engage with apertures 192 of enclosure wall 171 to releasably mount patch plate body 140 to enclosure wall 171. The electrical heater installed condition is achieved by then inserting electrical heater 100 in the installation direction "A" simultaneously through both installation aperture 138 of patch plate body 140 and clearance aperture 182. Clearance aperture 182 is created in enclosure wall 171 of a heating unit 186 such as a forced air furnace, heating unit plenum, air handler, portable or mounted electric heater, or the like. Assembly free end 180 of heating element assembly 104 is substantially fixed in the installed condition and does not require the use of assembly support rods connected to a rear plenum wall, such as assembly support rod 38 shown and described in reference to FIG. 1.

Figure 9:
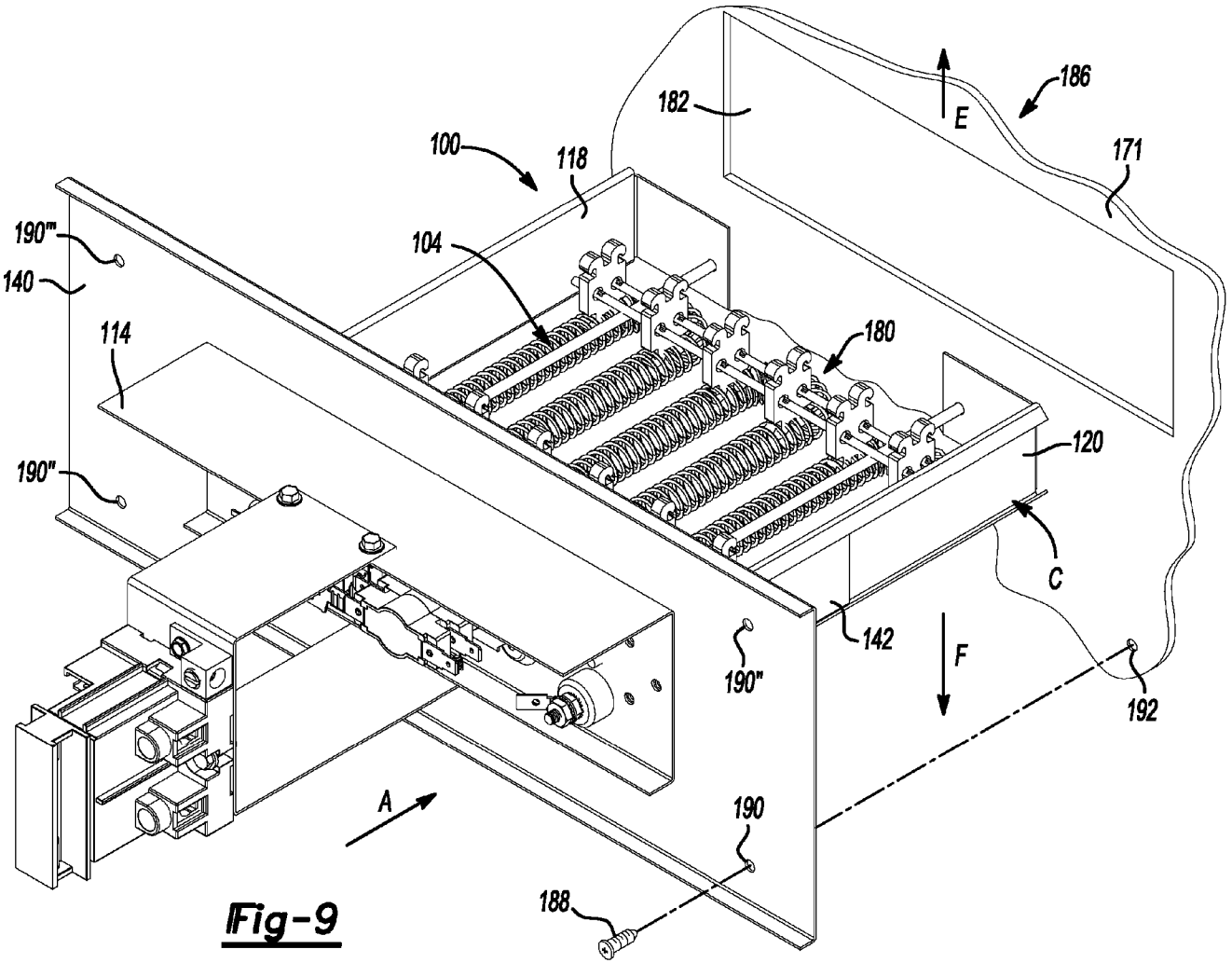
FIG. 9 is a left rear perspective view of the electric heater of FIG. 4 in a fully installed position.

With continued reference to FIGS. 6 and 9, housing member 114 is fastened or otherwise mechanically connected to patch plate body 140 after sliding insertion of heating element assembly 104 through both installation aperture 138 of patch plate body 140 and clearance aperture 182. Heating element assembly 104 is fully supported between first and second guide members 118, 120. Side-to-side and vertical upward or downward displacement of heating element assembly 104 is substantially precluded by static frictional contact of the first and second wings 142, 146 (only first wing 142 is visible in FIG. 9) within the capture zone height "C" with first and second guide members 118, 120. Displacement in either a first or second displacement direction "E", "F" of heating element assembly 104 is therefore substantially precluded. Individual coil members of heating element assembly 104 are thereby prevented from contacting patch plate body 140 or the plenum walls of the heating unit represented by enclosure wall 171 during the entire installation phase. The installer can therefore perform all of the installation sequence operations and make all connections from the housing member 114 side of electrical heater 100 prior to installation into heating unit 186 without requiring installation by "feel" and/or causing damage to any of the resistive heating elements or coil members.

Referring to FIG. 10, an electrical heater 200 according to further embodiments is supported using a modified patch plate 202 such that a quad heating element assembly 204 can be used. Heating element assembly 204 can include each of a first dual coil assembly 206 and a second dual coil assembly 208 both connected to a housing member 210. Other combinations and quantities of coil assemblies can also be used within the scope of the present disclosure.

First dual coil assembly 206 also includes first and second guide members 212, 214 which are connected to and extend perpendicular to housing member 210. Second dual coil assembly 208 is similarly provided with third and fourth guide members 216, 218 (only fourth guide member 218 is clearly visible in this view) connected and extending perpendicular to housing member 210. Modified patch plate 202 includes each of a first wing 222 and a second wing 224, which are aligned parallel to each other to slidably receive first and second guide members 212, 214, respectively. Similarly, modified patch plate 202 also includes third and fourth wings 226, 228 aligned parallel to each other to slidably receive the third and fourth guide members 216, 218. Quad heating element assembly 204 is slidably received in the installation direction "A" through an installation aperture 230 created in patch plate body 220. With further reference to FIG. 4, first, second, third, and fourth wings 222, 224, 226, 228 are each configured as shown and described with reference to first and second wings 142, 146, therefore further discussion of the configuration of first, second, third, and fourth wings 222, 224, 226, 228 is not provided herein.

Referring to FIG. 11, during installation of heating element assembly 204 through installation aperture 230, first and second support rods 232, 234 of first dual coil assembly 206 can be coupled using a cross support rod 236 to help maintain alignment with respect to first and second wings 222, 224. Also, a second cross support rod 238 can be provided with second dual coil assembly 208 to perform a similar function. The installation of electrical heater 200 is continued when housing member 210 is brought into direct contact with patch plate body 220 and connected thereto. Fasteners 240 inserted through housing member 210 are threadably engaged with apertures 242 created in patch plate body 220. The combination of electrical heater 200 and patch plate body 220 is then connected to a heating unit (not shown) similar to heating unit 186 shown and described in reference to FIG. 9. Apertures 244 are provided in patch plate body 220 to subsequently fastenably mount patch plate body 220 to the heating unit.

With continued reference to FIGS. 10 and 11, second dual coil or heating element assembly 208 defines a duplicate of the first dual coil or heating element assembly 206 with second heating element assembly 208 positioned below the first heating element assembly 206. The tracking system includes third and fourth guide members 216, 218 (only fourth guide member 218 is clearly visible) oppositely and outwardly positioned with respect to the second heating element assembly 208 and extending away from the housing member 210. The patch plate 202 has third and fourth wings 226, 228 extending away from the patch plate. The third and fourth guide members 216, 218 are positioned to individually slidingly engage with one of the third and fourth wings 226, 228 to permit the second heating element assembly 208 to be slidingly received through the installation aperture 230 without contact between the resistive heating element of the second heating element assembly 208 and the patch plate 202. A first central spacing "G" between the first and third wings 222, 226 equals a central spacing "H" between the first and third guide members 212, 216, and a second central spacing "J" between the second and fourth wings 224, 228 equals a central spacing "K" between the second and fourth guide members 214, 218.

When the first central spacing "G" is equal to the second central spacing "J" insertion of the first and second heating element assemblies 206, 208 into the installation aperture 230 can be in different orientations (with one orientation as shown in FIG. 10, and a second orientation having electrical heater 200 flipped upside-down from the orientation shown in FIG. 10). According to other embodiments, the first central spacing "G" is different than the second central spacing "J" thereby limiting insertion of the first and second heating element assemblies 206, 208 into the installation aperture 230 in only one orientation.

Similarly, and according to further embodiments, and again in reference to FIG. 10, a height "L" of at least one but less than all of the first, second, third, or fourth wings 222, 224, 226, 228 together with a corresponding height "M" of the first, second, third, or fourth guide members 2212, 214, 216, 218 can be varied from a height "N" of other ones of the first, second, third, or fourth wings 222, 224, 226, 228 to provide for limited insertion orientation of electrical heater 200 in only one orientation.

Referring to FIG. 12 and again to FIG. 9, an electrical heater 300 is modified from electrical heater 100 by providing a continuous wall about the heating elements. A first guide member 302 is integrally and according to several embodiments homogeneously connected to a second guide member 304 by a connecting end wall 306. Connecting end wall 306 includes apertures for receiving first and second support rods 126', 132'. A heating element assembly 308 is therefore contained within first and second guide members 302, 304 and connecting end wall 306. Connecting end wall 306 is therefore a continuous extension of first and second guide members 302, 304.

Referring to FIG. 13 and again to FIG. 12, according to additional embodiments, an electrical heater 400 is modified from electrical heater 300 by providing a releasable end wall to protect the heating elements. First and second guide members 402, 404 each have an angularly oriented first and second end wall 406, 408 respectively, which further include first and second guide flanges 410, 412 extending from a first planar wall 414, and third and fourth guide flanges 414, 416 extending from a second planar wall 420. First and second end walls 406, 408 can be created by bending material of first and second guide members 402, 404. A connecting wall 422 is slidably received by the first, second, third and fourth guide flanges 410, 412, 416, 418. Connecting wall 422 includes first and second elongated slots allowing first and second support rods 126', 132' to be slidably received during installation of connecting wall 422. Connecting wall 422 can then be fastened, crimped, or otherwise fixed to first and second end walls 406, 408 to partially enclose a heating element assembly 428.

The patch plates 102, 202 of the present disclosure can be separate items provided with the electrical heaters 100, 200 which permit electrical heaters 100, 200 to be used in backfit or replacement service where replacement of a pre-installed electrical heater is required. In these applications, patch plates 102, 202 having the individual wings (142, 146; or 222, 224, 226, 228) can be manufactured off-site and can be separately connected to the furnace or plenum wall at the job site. According to other embodiments, patch plates 102, 202 can be integrally provided with or connected to the original installation furnace or plenum wall, having the wings ready to be deployed to their perpendicular rotated positions. In these applications, only the heating element assembly 104, 204 is required to complete the installation.

Although track system 147 of the present disclosure provides first and second guide members 118, 120 and first and second wings 142, 146 in the embodiment of FIG. 4, a track system of the present disclosure can also use only a single one of the guide members and a single one of the wings. Placement of the single guide member and wing can be at either side of the heating element assembly 104, or located between and above or below the resistive heating elements at the discretion of the manufacturer.

Electrical heaters of the present disclosure offer several advantages. Guide members having guide flanges that slidably couple to wings of a patch plate ensure the alignment of the heating element assembly during the entire installation phase and therefore prevent coil members from being damaged by contacting the patch plate or a plenum wall of the heating unit. Continued engagement of the guide members to the wings provides longitudinal and lateral support for the heating element assembly in the installed position which obviates the need for a support rod connected to a second wall of the heating unit. All operations including alignment for a sliding installation, making electrical connections, and fastening to complete the installation are performed from the installer's side of the electrical heater. The guide members also provide positive outer containment and maintain alignment of the heating element assembly at all times.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heater assembly, comprising:

a heating element assembly comprising at least one guide member cantileverly extending rearwardly from a housing member, and a resistive heating element supported by the at least one guide member; and a patch plate for supporting the heating element assembly and for mounting the heating element assembly to an air handler, the patch plate having an installation aperture and at least one wing integrally formed as a part of the patch plate and cantileverly extending rearwardly from the patch plate, the at least one wing slidingly engaged with the at least one guide member, wherein the heating element assembly is slidingly and removably received through the installation aperture without contact between the resistive heating element and the patch plate.

2. The heater assembly of claim 1, wherein the at least one guide member comprises first and second guide members oppositely and outwardly positioned with respect to the heating element assembly.

3. The heater assembly of claim 2, wherein the at least one wing comprises first and second wings extending perpendicular to the patch plate and parallel to the first and second guide members, the first and second guide members individually positioned to slidingly engage with one of the first and second guide members.

4. The heater assembly of claim 1, wherein the at least one guide member includes a longitudinal wall having first and second guide flanges extending therefrom, wherein the at least one wing is slidingly captured between the first and second guide flanges and the longitudinal wall permitting only a sliding motion of the at least one guide member with respect to the at least one wing.

5. The heater assembly of claim 4, wherein the first and second guide flanges are directed toward each other and are each oriented at an acute angle with respect to the longitudinal wall.

6. The heater assembly of claim 1, wherein the at least one guide member includes first and second substantially parallel guide members each including a longitudinal wall connected to the housing member and an end wall angularly oriented with respect to the longitudinal wall, the end wall positioned proximate to a free end of the heating element assembly.

7. The heater assembly of claim 6, further including first and second support rods each connected to the housing member and freely extending through an aperture created in one of the end walls of the first and second guide members, the first and second support rods supporting the resistive heating element.

8. The heater assembly of claim 6, further including:

first and second guide flanges extending from the end wall of each of the first and second guide members; and a connecting end wall slidably received by the first and second guide flanges of the first and second guide members.

9. The heater assembly of claim 6, wherein the at least one guide member includes first and second substantially parallel guide members having an end wall oriented perpendicular to the first and second guide members defining a continuous extension of the first and second one guide members.

10. A heater assembly, comprising:

a heating element assembly comprising a resistive heating element, and first and second guide members cantileverly extending rearwardly from a housing member, the first and second guide members positioned on opposite sides of and supporting the resistive heating element; and a patch plate for supporting the heating element assembly and for mounting the heating element assembly to an air handler, the patch plate having an installation aperture and fixed first and second wings cantileverly extending rearwardly from the patch plate, each of the first and second wings engaged with and supporting a respective one of the first and second guide members, wherein the heating element assembly is slidingly and removably received through the installation aperture via the engaged first and second wings and the first and second guide members without contact between the resistive heating element and the patch plate.

11. The heater assembly of claim 10, wherein each of the first and second guide members include a longitudinal wall having first and second guide flanges extending therefrom wherein one of the first and second wings is slidingly captured between the first and second guide flanges and the longitudinal wall permitting only a sliding motion of the first and second guide members in an installation direction with respect to individual ones of the first or second wings.

12. The heater assembly of claim 11, wherein the first and second guide flanges are each oriented at an acute angle with respect to the longitudinal wall each defining a capture zone to slidably receive the first or second wing and prevent the first or second wing from moving in an outward displacement direction perpendicular to the installation direction.

13. The heater assembly of claim 10, wherein the first and second guide members each include a longitudinal wall connected to the housing member and an end wall angularly oriented with respect to the longitudinal wall, the end wall positioned proximate to a free end of the heating element assembly, the end wall of the first guide member oriented co-planar with and facing the end wall of the second guide member.

14. The heater assembly of claim 13, further including first and second support rods each connected to the housing member and individually freely extending through an aperture created in the end wall of one of the first or second guide members, the first and second support rods supporting the resistive heating element.

15. The heater assembly of claim 13, wherein the end wall further includes a planar wall portion having guide flanges extending therefrom, the guide flanges oriented at an acute angle with respect to the planar wall portion.

16. The heater assembly of claim 13, further including a connecting plate slidingly received between the guide flanges of the end wall of both the first and second guide members.

17. The heater assembly of claim 10, wherein the heating element assembly further includes a plurality of transverse support rods oriented perpendicular to the first and second guide members, and a plurality of spacer members positioned on the transverse support rods and connected to the resistive heating element, the transverse support rods positioned between and contacting the first and second guide members to minimize motion of the resistive heating element between the first and second guide members.

18. The heater assembly of claim 10, wherein each of the first and second wings integrally connect to an extending portion extending from an edge wall defined by the installation aperture, and each of the first and second wings include wing extension portions extending above and below the extending portion.

19. The heater assembly of claim 10, wherein each of the first and second wings includes a plurality of axially aligned apertures separating a plurality of lands together defining a bend location permitting the first and second wings to be oriented perpendicular to the patch plate.

20. The heater assembly of claim 10, wherein the resistive heating element comprises at least one coil and the heating element assembly defines an open coil assembly.

21. The heater assembly of claim 10, wherein a width of the second wing is different than a width of the first wing such that the second guide member can only receive the second wing and the first guide member can only receive the first wing, the heating element assembly thereby limited to insertion into the installation aperture in only one orientation.

* * * * *